US006758040B1

(12) United States Patent
Cantu

(10) Patent No.: US 6,758,040 B1
(45) Date of Patent: Jul. 6, 2004

(54) HIGH HEAT PRODUCING POWER SYSTEM

(76) Inventor: Valeriano Cantu, 4137 Ames Blvd., #70, Marrero, LA (US) 70072

( * ) Notice: Subject to any disclaimer, the term of this patent is extended or adjusted under 35 U.S.C. 154(b) by 0 days.

(21) Appl. No.: 10/037,946

(22) Filed: Jan. 3, 2002

(51) Int. Cl.[7] ..... F01K 3/00
(52) U.S. Cl. ..... 60/508; 60/509; 60/513; 60/515
(58) Field of Search ..... 60/508, 509, 512, 60/513, 515

(56) References Cited

U.S. PATENT DOCUMENTS 3,739,573 A * 6/1973 Giner ..... 417/394
4,385,494 A * 5/1983 Golben ..... 60/513
6,012,286 A * 1/2000 Cantu ..... 60/509

* cited by examiner

*Primary Examiner*—Hoang Nguyen
(74) *Attorney, Agent, or Firm*—Pugh/Associates, Patent & TM Attorneys; C. Emmett Pugh

(57) ABSTRACT

A high heat producing system which encapsulates a deflected rotating laser beam in a chamber and propagates it through a gaseous medium within the chamber. The heat energy of the deflected rotating laser beam agitates the molecules of the gaseous medium such that the temperature of the gaseous medium increases to at least about two thousand (2000° F.) degrees Fahrenheit, thereby increasing the temperature of the high heat producing device. In the preferred embodiment, the high heat producing device is in direct heat transfer with a working fluid in an expansion chamber for powering, for example, a turbine or the like.

20 Claims, 5 Drawing Sheets

HIGH HEAT PRODUCING POWER SYSTEM

REFERENCE TO RELATED PATENT APPLICATION & PATENT

This application is a substitute application for Ser. No. 09/134,390 filed Aug. 14, 1998, entitled "High Heat Producing System," now abandoned, and relates to some of the same technology as applicant's prior patent application Ser. No. 09/050,835 filed Mar. 30, 1998, now U.S. Pat. No. 6,012,286 also entitled "High Heat Producing System," the disclosures of which are incorporated herein by reference.

TECHNICAL FIELD

The present invention relates to power producing devices or systems, and more particularly to a high heat producing system which encapsulates a deflected rotating laser beam in a chamber and propagates it through a gaseous medium within such chamber. The heat energy of the deflected rotating laser beam agitates the molecules of the gaseous or fuel medium such that the temperature of the gaseous medium increases to at least about two thousand (2,000° F.) degrees Fahrenheit, thereby increasing the temperature of the high heat producing device. In the preferred embodiment, the high heat producing device is in direct heat transfer with a working fluid in an expansion chamber for powering, for example, a turbine or the like.

BACKGROUND ART

Systems which convert heat energy to mechanical or electrical sources of power are known. For example, some turbine engines utilize a source of heat such as from an expansion chamber to heat a working fluid having expansion properties when heated. The working fluid is vaporized and expanded via heat energy to power turbines.

There are numerous sources of heat, one of which is as simple as a flame. The biggest challenge in creating heat energy is the source of fuel which undergoes combustion to produce the necessary temperature. Such source of fuel becomes depleted over time as the combustion thereof takes place. Therefore, a reservoir for storing therein significant amounts of fuel to maintain the engine powered must be provided. Furthermore, such reservoir occupy space and must be refilled from time-to-time. Other sources of heat include chemical reactions. A drawback with typical sources of heat energy is the limitation of the maximum achievable base temperature created by the combustion of fuel or the chemical reaction. However, in some applications, it is desirable to heat a working fuel to a very high temperature. Another drawback with known sources of heat energy is that the exhaust from the combustion of fuel or a chemical reaction are expelled into the environment.

A listing of prior patents, which may be relevant to the invention, is presented below:

| Patent No. | Patentee(s) | Issue Date |
|---|---|---|
| 1,804,694 | Jones | May 12, 1931 |
| 3,447,314 | Majkrzak | Jun. 3, 1969 |
| 3,516,249 | Paxton | Jun. 23, 1970 |
| 3,972,195 | Hays et al. | Aug. 3, 1976 |
| 4,170,116 | Williams | Oct. 9, 1979 |
| 4,291,232 | Cardone et al. | Sep. 22, 1981 |
| 5,182,913 | Robar et al. | Feb. 2, 1993 |

-continued

| Patent No. | Patentee(s) | Issue Date |
|---|---|---|
| 5,336,059 | Rowley | Aug. 9, 1994 |
| 5,373,698 | Taylor | Dec. 20, 1994 |

The Jones (U.S. Pat. No. 1,804,694) discloses a mercury vapor turbine in which the mercury is vaporized by a flame which vaporized mercury is used to drive a turbine for powering automobiles and airplanes.

The Majkrzak (U.S. Pat. No. 3,447,314) is directed to a mercury-vapor turbo-generator used, for example to provide electrical power at a remote location. In the turbo-generator mercury in liquid form is initially heated and then superheated by combustion exhaust gases.

The Paxton (U.S. Pat. No. 3,516,249) discloses a mercury turbine which uses a mercury boiler and mercury pump in which the mercury components are used to heat water to run a steam turbine.

The Hays et al. (U.S. Pat. No. 3,972,195) discloses an inert gas turbine engine. The invention by Hays et al. teaches the use of a combustion chamber which includes a fuel manifold connected to a fuel nozzle and an ignitor which initiates combustion within the combustion chamber. The fuel nozzle is located at the entry of the combustion chamber such that fuel can be mixed with compressed air as the air enters the combustion chamber and flows rearwardly. The ignitor then ignites the fuel and air mixture within the combustion chamber. The combusted gases within the combustion chamber will heat the expansion chamber which is in heat transfer relationship with the combustion chamber. The working fluid within the expansion chamber will then be vaporized. The increase in pressure due to the working fluid expansion will force the vaporized fluid through the turbine nozzles thereby rotating turbine wheels.

The Williams (U.S. Pat. No. 4,170,116) discloses a number of possible working fluids for his thermal energy to mechanical conversion system, including, for high temperature applications, mercury.

The Cardone et al. (U.S. Pat. No. 4,291,232) discloses the use of ammonia dissolved in water and when ammonia is dissolved in water, a great deal of heat is given off as the heat of solution, about eight and four-tenths (8.4) kilo-calories per mole, using pure reactants. The Cardone et al. patent further discloses other solvents which can be used with water.

The Robar et al. (U.S. Pat. No. 5,182,913) discloses an engine system which uses a refrigerant fluid. The system utilizes the heat from the combustion of propane fuel by means of a burner element. Robar et al. also discloses that other fuels such as natural gas, gasoline, oil or other hydrocarbon fuels may be substituted.

The Rowley (U.S. Pat. No. 5,336,059) discloses a rotary heat driven engine. The liquid refrigerant is in a boiler or power evaporator and is heated to a vapor creating pressure.

The Taylor (U.S. Pat. No. 5,373,698) discloses a inert gas turbine engine which heats a working fluid within an expansion chamber. The working fluid within the expansion chamber is heated by the combustion of compressed air and fuel within the combustion chamber. The heated working fluid within the expansion chamber rotates an expansion turbine which in turn rotates a compressor.

While each of the sources of heat energy described above function as desired, none of them disclose a high heat producing device which encapsulates in a chamber and propagates through a gaseous medium within such chamber a deflected rotating laser beam. The heat energy of the deflected rotating laser beam agitates the molecules of the fuel or gaseous medium such that the temperature of the gaseous medium or fuel increases to at least about two thousand (2,000° F.) degrees Fahrenheit thereby increasing the temperature of the high heat producing device. In the preferred embodiment, the high heat producing device is in direct heat transfer with a working fluid in an expansion chamber for powering a turbine or the like.

As will be seen more fully below, the present invention is substantially different in structure, methodology and approach from that of the prior fire producing devices.

GENERAL DISCUSSION OF INVENTION

The preferred embodiment of the high heat producing device of the present invention solves the aforementioned problems in a straight forward and simple manner. What is provided is a high heat producing system which encapsulates in a chamber and propagates through a fuel or gaseous medium within such chamber a deflected rotating laser beam. The heat energy of the deflected rotating laser beam agitates the molecules of the gaseous medium such that the temperature of the gaseous medium increases to at least about two thousand (2,000° F.) degrees Fahrenheit thereby increasing the temperature of the high heat producing device. In the preferred embodiment, the high heat producing device is in direct heat transfer with a working fluid in an expansion chamber for powering a turbine or the like.

The high heat producing device of the present invention comprises: an enclosure having a center axis and has free space wherein said enclosure is defined by a top surface member and a bottom surface member in parallel spaced relation and an outer perimeter surface coupled to the outer perimeter edge of said top and bottom surface members and wherein said enclosure radiates heat energy therefrom; a gaseous medium filled in said free space; a continuous beam deflecting ring member coupled to an interior surface of said outer perimeter surface; a rotating laser beam deflector coupled in a center axis of said bottom surface member; and, a laser beam source for radiating a laser beam wherein the laser beam is radiated along the center axis to the rotating laser beam deflector and is deflected to propagate the laser beam radially from the center axis through the gaseous medium to the continuous beam deflecting ring member. The laser beam agitates the molecules of the gaseous medium, and the friction between the molecules increases the heat energy.

The method of producing high heat of the present invention comprises the following steps:

providing a high heat producing system wherein the high heat producing system comprises an enclosure having a center axis and has free space wherein said enclosure is defined by a top surface member and a bottom surface member in parallel spaced relation and an outer perimeter surface coupled to the outer perimeter edge of said top and bottom surface members and wherein said enclosure radiates heat energy therefrom; a gaseous medium filled in said free space; a continuous beam deflecting ring member coupled to an interior surface of said outer perimeter surface; a rotating laser beam deflector coupled in a center axis of said bottom surface member; and, a laser beam source for radiating a laser beam wherein the laser beam is radiated along the center axis to the rotating laser beam deflector and is deflected to propagate said laser beam radially from the center axis through the gaseous medium to the continuous beam deflecting ring member;

propagating said laser beam along said center axis to said rotating laser beam deflector;

rotating said rotating laser beam deflector and simultaneously deflecting said laser beam radially from said center axis through said gaseous medium;

agitating molecules of the gaseous medium as said laser beam is propagated through said gaseous medium and creating friction between the molecules to increase the heat energy of said enclosure.

In view of the above, an object of the present invention is to provide a high heat producing device which couples a relatively low voltage readily available such as from the public utility company and couples the voltage to power a laser beam source to create a laser beam.

The laser beam is propagated through a gaseous medium, such as, without limitation, mercury, to the continuous beam deflecting ring member within the laser encapsulation chamber.

In the preferred embodiment, such rotating laser beam deflector includes at least one reflective mirror angled to deflect at least one laser beam from the center axis radially outward therefrom and is rotated between eighteen hundred and thirty-six hundred (1,800–3,600 RPMs) revolutions per minute. As can be appreciated, if visually observed, a continuous illuminating heat energy field is created since the at least one laser beam is propagated to and reflected from the continuous beam deflecting ring member positioned at the outer perimeter edge of the encapsulation chamber as the rotating laser beam deflector is rotated.

Another object of the present invention is to provide a high heat producing device which has application in environments which require very high heat which could not be otherwise achieved by the combustion of fuel or chemical reactions.

It is a still further object of the present invention to provide a high heat producing device which produces heat from the application of electric power to power a laser beam to agitate molecules of the gaseous medium and create friction therebetween to create super heat energy radiating from the encapsulation chamber.

It is a still further object of the present invention to provide a high heat producing device which serves the function of the combustion chamber of conventional turbine engine systems.

It is a still further object of the present invention to provide a high heat producing device which is receivable within an expansion chamber having filled therein a working fluid medium which has expansion properties when heated wherein the high heat producing device is in direct heat transfer relation with the working fluid medium of the expansion chamber.

The above and other objects of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers, and wherein.

DESCRIPTION OF THE PREFERRED EMBODIMENT

Figure 1:
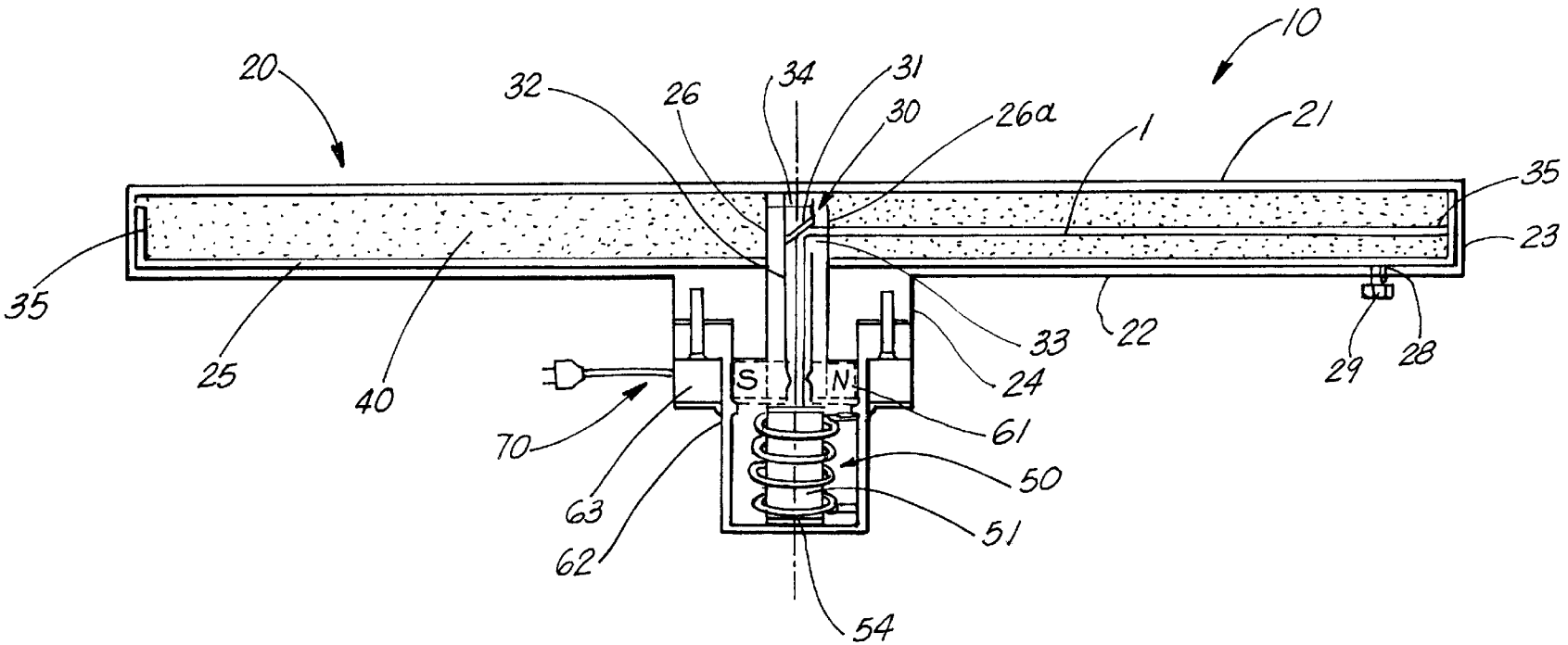
FIG. 1 is a cross-sectional view of a first, exemplary embodiment of the high heat producing device of the present invention.

As can be seen in FIG. 1, the first initial, exemplary embodiment of the high heat producing device of the invention is designated by the reference numeral 10. The high heat producing device 10 comprises a laser encapsulation chamber 20, a rotating laser beam deflector 30, a continuous beam deflecting ring member 35, a gaseous medium 40, a laser beam source 50 and a rotor means 70.

Figure 2:
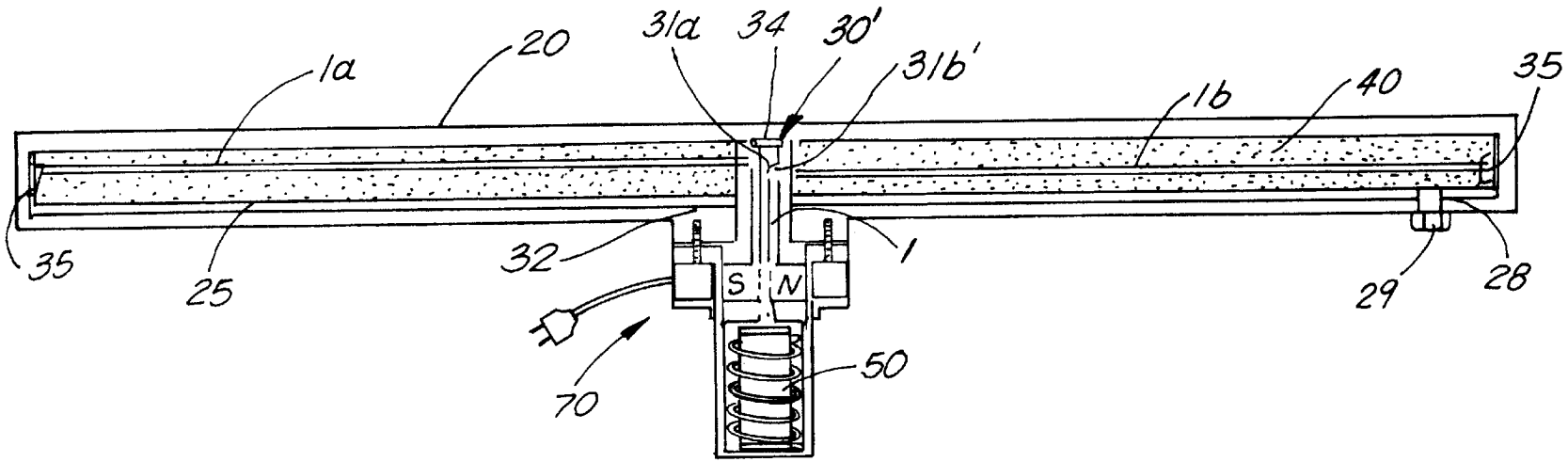
FIG. 2 is a cross-sectional view of a second, exemplary embodiment of the high heat producing device of the present invention.
Figure 3:
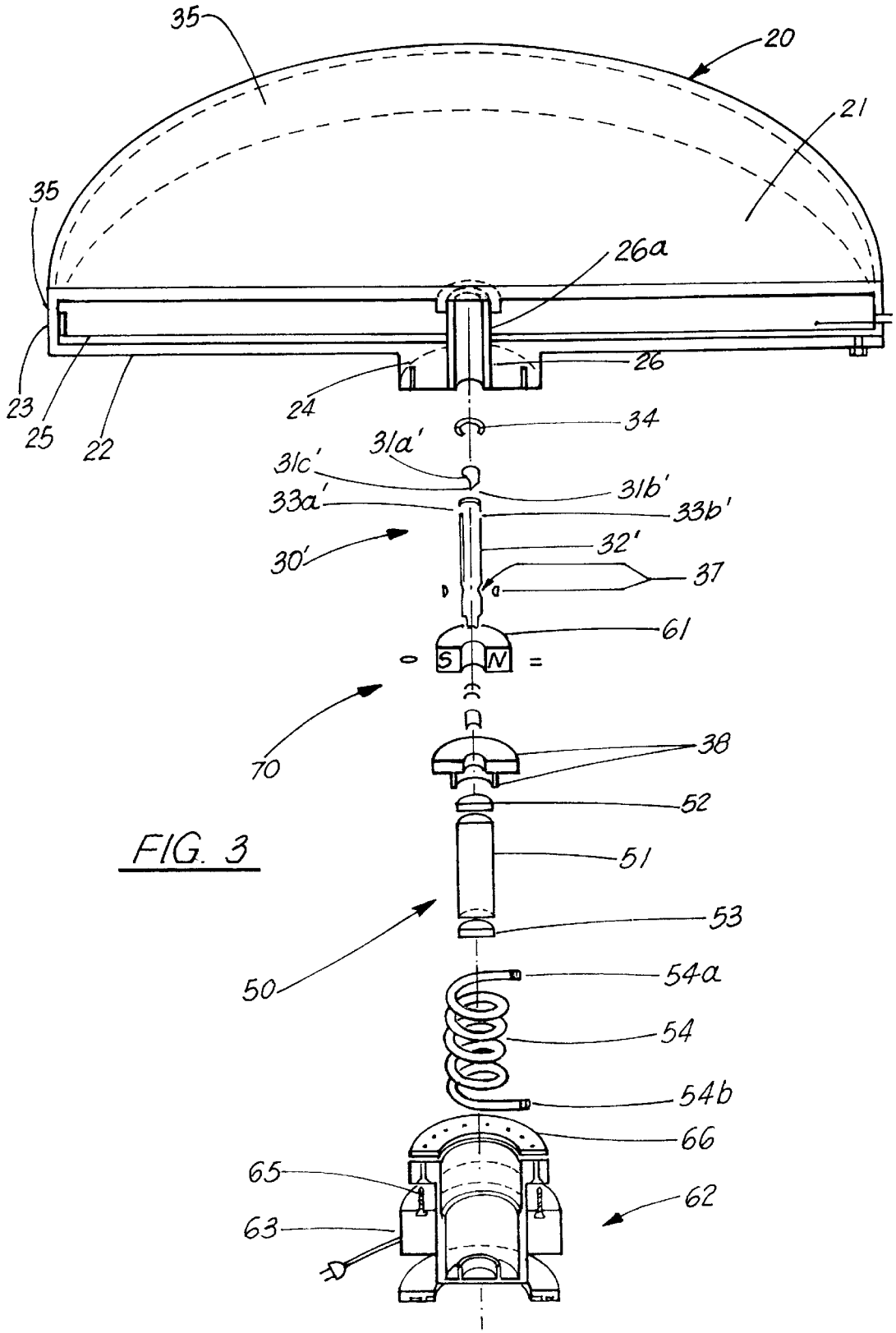
FIG. 3 is an exploded view of the second, exemplary embodiment of the high heat producing device of the embodiment of FIG. 2.
Figure 4:
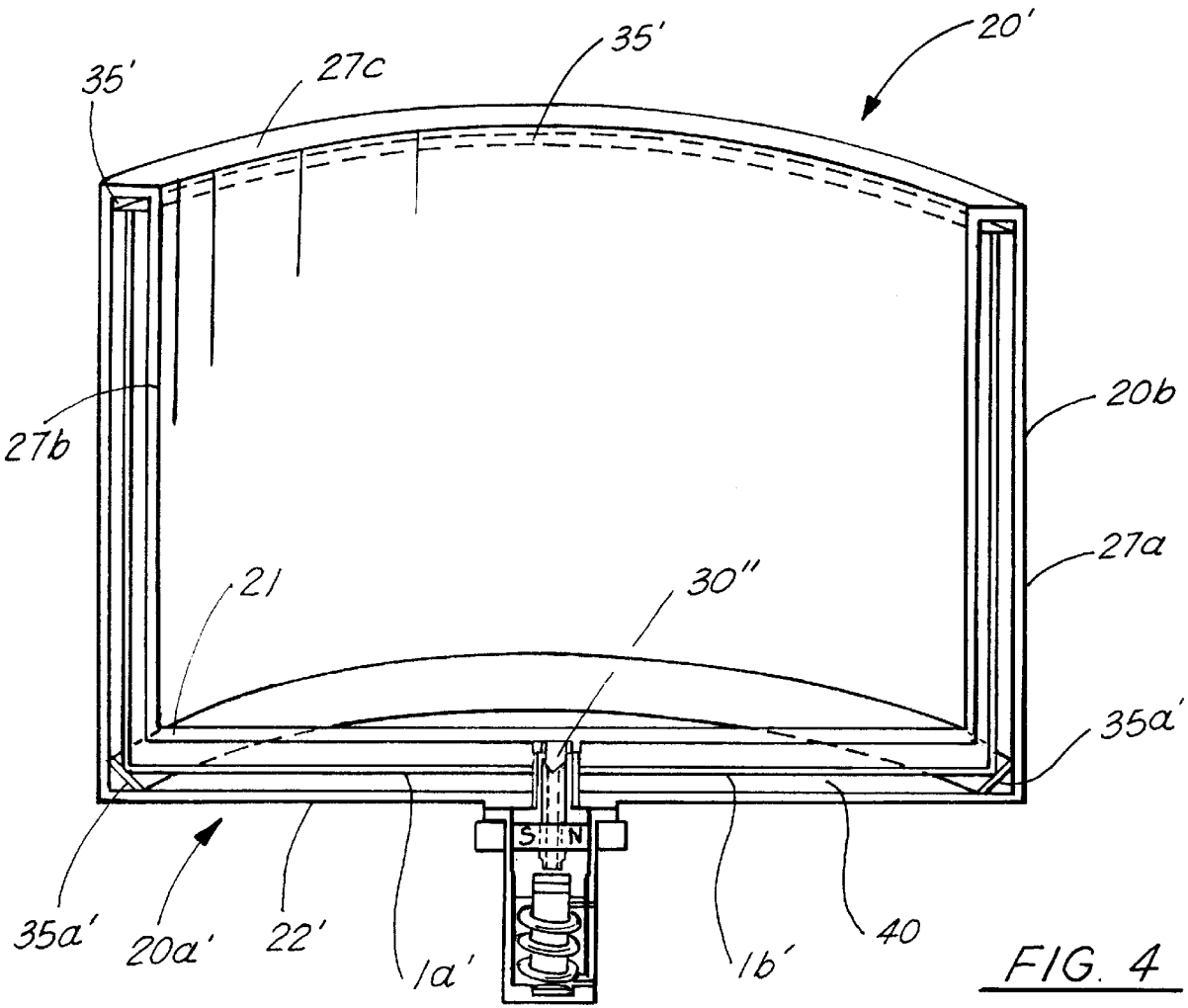
FIG. 4 is a cross-sectional view of a third, exemplary embodiment of the high heat producing device of the present invention.

The laser encapsulation chamber 20 comprises an enclosure for encapsulating therein the gaseous medium 40 and the at least one laser beam 1. The enclosure may be disc shaped, as best seen in FIGS. 1–3, a cylindrically-shaped cavity, as best seen in FIG. 4, or any other shape desired to produce the desired objectives desired herein below. The laser encapsulation chamber 20 of the exemplary embodiment of FIGS. 1–3 and the laser encapsulation chamber 20' of the alternative embodiment of FIG. 4 differs in the outer perimeter contours of such laser encapsulation chambers.

Figure 5:
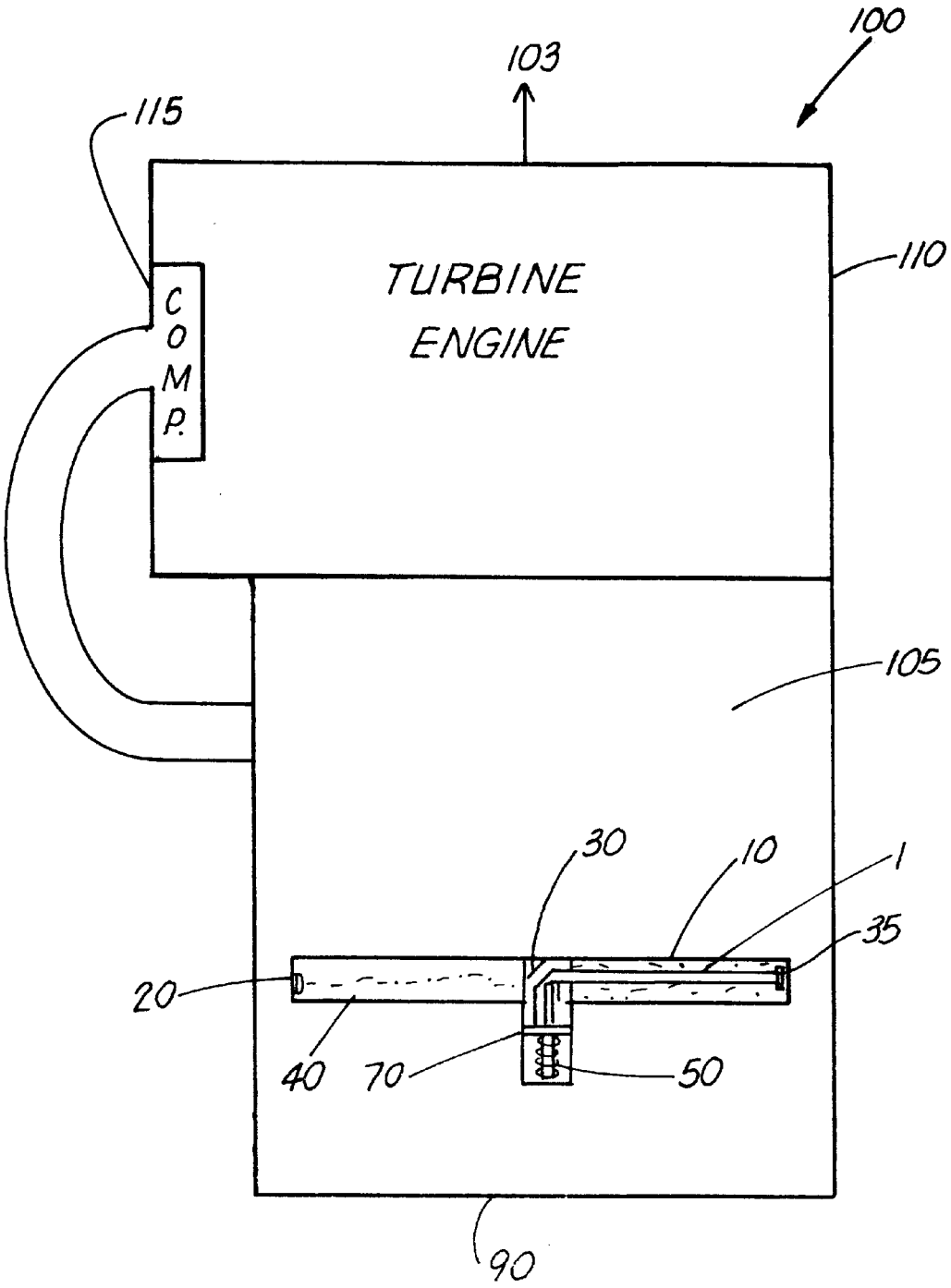
FIG. 5 is a view of an exemplary turbine engine system incorporating the high heat producing device of the embodiment of FIG. 1.

In the first embodiment, as shown in FIGS. 1–3, the laser encapsulation chamber 20 is disc shaped. The diameter of the disc-shaped laser encapsulation chamber can be maximized to the dimensions of the expansion chamber 90 of the turbine engine system 100, as best seen in FIG. 5, in which the high heat producing device 10 is placed.

The laser encapsulation chamber 20 comprises a top disc-shaped surface 21, a bottom disc-shaped surface 22 and a circumferentially disposed outer perimeter surface 23 which separates the top disc-shaped surface 21 and the bottom disc-shaped surface 22. The top disc-shaped surface 21 and the bottom disc-shaped surface 22 are in parallel spaced relation with each other and the free space created by the gap there between has filled therein fuel or gaseous medium 40. The interior surface of the circumferentially disposed outer perimeter surface 23 has coupled thereto the continuous beam deflecting ring member 35, such as a reflective mirror. The reflective surface of the mirror reflects interiorly the laser beam 1 back toward the center axis of the laser encapsulation chamber 20.

The bottom disc-shaped surface 22 has coupled in the center axis thereof the rotating laser beam deflector 30 and to a bottom surface thereof rotor coupler 24. The gap between the top and bottom disc-shaped surfaces 21 and 22 provides the necessary spacing for the unhindered rotation of the rotating laser beam deflector 30. The bottom disc-shaped surface 22 has interiorly coupled thereto a heat reflecting means 25 made of material having heat reflecting properties so that heat will be directed upwardly to the top disc-shaped surface 21. The top and bottom disc-shaped surfaces 21 and 22 and the circumferentially disposed outer perimeter surface 23 create a sealed laser encapsulation chamber 20.

The sealed laser encapsulation chamber 20 further comprises inlet/outlet port 28 which serves as an air evacuator or gaseous medium injector orifice. The inlet/outlet port 28 includes pressure valve release member 29 to allow the air to evacuate therefrom or control the pressure in the sealed laser encapsulation chamber 20. Moreover, the inlet/outlet port 28 in combination with the pressure valve release member 29 serves to permit the gaseous medium 40 to be replenished (injected) into the laser encapsulation chamber 20.

The laser encapsulation chamber 20 further comprises a laser beam deflecting chamber 26 coupled along the center axis thereof. The laser beam deflecting chamber 26 propagates therein and deflects therefrom laser beam 1 via rotating laser beam deflector 30. The laser beam deflecting chamber 26 comprises a generally cylindrically shaped member made of transparent material wherein the laser beam deflecting chamber 26 functions to seal the gas within the laser encapsulation chamber 20 along the opening about the center axis. Moreover, the transparent material of the cylindrically shaped member allows the laser beam 1 to be transmitted therethrough to a continuous beam deflecting ring member 35. In general, the generally cylindrically shaped member made of the transparent material serves as a beam window 26*a* in which the deflected laser beam 1 shines therethrough and into the laser encapsulation chamber 20. The beam window 26*a* is that portion of the cylindrically shaped member which is in the laser encapsulation chamber 20.

The rotating laser beam deflector 30 comprises an angled deflector surface 31 disposed at an angle in the laser beam deflecting chamber 26. Angled deflector surface 31 includes a deflecting mirrored surface which reflects angularly downward at a predetermined angle from the center axis to deflect radially outward through the beam window 26*a* the laser beam 1. Thereby, when the laser beam 1 is radiated upward along the center axis, the laser beam 1 is angled in such a manner that the laser beam is deflected approximately ninety (90°) degrees, out through the beam window 26*a* and propagated through the gaseous medium 40 to the continuous beam deflecting ring member 35. As can be appreciated, the continuous beam deflecting ring member 35 reflects/deflects laser beam 1 back toward the center axis.

The rotating laser beam deflector 30 further comprises a hollow shaft 32 which is concentric with laser beam deflecting chamber 26 and which supports therein the angled deflector surface 31. The top portion of the hollow shaft 32 has formed therein an upper aperture 33 which allows the laser beam 1 to propagate therethrough. The top of the hollowed shaft 32 is coupled to top disc-shaped surface 21 via bushing/bearing coupling 34. In the exemplary embodiment, the bushing/bearing coupling 34 is a graphite lubed bushing.

In the first preferred embodiment (the embodiment of FIG. 1), there is only one laser beam 1. However, the embodiment of FIGS. 2 and 3, the laser beam 1 is split into two the laser beams 1*a* and 1*b* spaced essentially one hundred and eighty (180°) degrees with respect to each other via rotating laser beam splitter deflector 30'. Nevertheless, in lieu of one or two laser beams, three or four, etc., laser beams may be circumferentially radiated through beam window 26*a* having a one hundred (120°) or ninety (90°) degrees, etc., respectively, spacing therebetween depending on the configuration of the rotating laser beam deflector located at the center axis.

Referring still to FIGS. 2 and 3, rotating laser beam splitter deflector 30' comprises an upper angled deflector surface 31*a'* and a lower angled deflector surface 31*b'* wherein laser beam 1 propagated along the center axis is first split essentially in half by the lower angled deflector surface 31*b'*. More specifically, as laser beam 1 is propagated along the center axis, essentially half of the laser beam 1 is deflected by approximately by ninety (90°) degrees by the obstruction created by the lower angled deflector surface 31*b'* to create laser beam 1*b*. The other half of the laser beam 1 propagated along the center axis is not obstructed and is propagated to the upper angled deflector surface 31*a'* which deflects the other half of the laser beam 1 by approximately by ninety (90°) degrees to create laser beam 1*b* and is spaced essentially one hundred and eighty (180°) degrees with respect to laser beam 1*b*. The upper angled deflector surface 31*a'* and the lower angled deflector surface 31*b'* reflect downward so that the upwardly propagated laser beam 1 can be split and deflected radially outward from the center axis.

Rotating laser beam splitter deflector 30' further comprises a hollow shaft 32' which is concentric with laser beam deflecting chamber 26 which supports therein an upper angled deflector surface 31*a'* and a lower angled deflector surface 31*b'*. The top portion of the hollow shaft 32' has formed therein an upper aperture 33*a'* and a lower aperture 33*b'* which is spaced from the upper aperture 33*a'* by essentially one hundred and eighty (180°) degrees. The upper aperture 33*a'* and the lower aperture 33*b'* allow the laser beams 1*a* & 1*b*, respectively, to propagate therethrough.

The top of the hollowed shaft is coupled to top disc-shaped surface 21 via bushing/bearing coupling 34. Furthermore, the upper angled deflector surface 31*a'* and the lower angled deflector surface 31*b'* are joined together via a center axis divider member 31*c'* aligned with the center axis wherein one end of the center axis divider member 31*c'* is coupled to one end of the lower angled deflector surface 31*b'* and the other end is coupled to one end of the upper angled deflector surface 31*a'*. Thereby, as the laser beam 1 is split, said other half of laser beam 1 follows along the center axis divider member 31*c'* to the upper angled deflector surface 31*a'*.

The other end of laser beam deflecting chamber 26 has coupled thereto laser beam source 50 and the rotor means 70. Laser beam source 50 comprises a laser body 51, a laser beam passing mirror 52, a lower laser mirror 53 and spring loaded contacts 54*a* and 54*b* with flash lamp electric coil member 54. Laser body 51 is essentially cylindrically shaped wherein the longitudinal axis of the cylindrical shaped laser body 51 is aligned essentially with the center axis of the laser encapsulation chamber 20.

The laser beam passing mirror 52 is disposed at the top end of the laser body 51. The lower laser mirror 53 is disposed at the lower end of the laser body 51. The cylindrically shaped laser body 51 has coiled there around flash lamp electric coil member 54.

Power is supplied to the flash lamp electric coil member 54 via the spring loaded contacts 54*a* & 54*b*. The same power which powers the rotor means 70 may be used to power the flash lamp electric coil member 54 or an alternate power cord may be provided.

Rotor means 70 comprises a permanent magnet rotor 61 coupled in a non-magnetic electric insulator member 62, while the non-magnetic electric insulator member 62 is coupled in a donut stator 63. The non-magnetic electric insulator member 62 forms part of the mating connection with rotor coupler 24. The non-magnetic electric insulator member 62 is secured to rotor coupler 24 via a plurality of securing means 65. Furthermore, sandwiched between the non-magnetic electric insulator member 62 and the rotor coupler 24, there is a gasket 66 which is preferably made of high heat resistant material. The donut stator 63 is electrically connected to low voltage.

The lower portion of the non-magnetic electric insulator member 62 houses therein the laser beam source 50. The center axis of the permanent-magnet rotor 61 is hollow to permit the laser beam 1 from the laser beam source 50 to propagate along the center axis and through the hollow center of the permanent-magnet rotor 61 and into the laser beam deflecting chamber 26 of the laser encapsulation chamber 20.

Additionally, the permanent-magnet rotor 61 has coupled thereto the hollow shaft 32 of rotating laser beam deflector 30 or, alternately, the hollow shaft 32' of the rotating laser beam splitter deflector 30' via a slot/key configuration 37. Furthermore, coupler 38 couples permanent-magnet rotor 61 and the laser beam source 50 together in such a manner that laser beam source 50 remains stationary while permanent-magnet rotor 61 rotates.

In the exemplary embodiment, the rotor means 70 is capable of spinning at speed of about eighteen hundred to thirty-six hundred (1,800–3,600 RPMs) revolutions per minute. Nevertheless, rotor means 70 can be operated at any desired speed. Thereby, as the permanent-magnet rotor 61 of the rotor means 70 is rotated, the hollow shaft 32 of rotating laser beam deflector 30 or, alternately, the hollow shaft 32' of the rotating laser beam splitter deflector 30' is rotated therewith. As the hollow shaft 32 of rotating laser beam deflector 30 or, alternately, the hollow shaft 32' of the rotating laser beam splitter deflector 30' is rotated, the rotating laser beam deflector 30 or, alternately rotating laser beam splitter deflector 30' is rotated by virtue of their couplings to the hollow shaft 32 or, alternately the hollow shaft 32'.

Referring now to FIG. 4, the laser encapsulation chamber 20' is a cylindrically-shaped hollow cavity having a closed bottom end. The laser encapsulation chamber 20' comprises a generally bottom disc-shaped enclosure 20*a* and a vertically upright cylindrical wall enclosure 20*b*. The generally bottom disc shaped housing portion 20*a* comprises a top disc-shaped surface 21' and a bottom disc-shaped surface 22' structured in a similar manner as the laser encapsulation chamber 20 described above in relations to FIGS. 1–3.

However, the bottom disc-shaped surface 22' has a larger diameter than the top disc-shaped surface 21'. The top disc-shaped surface 21' and the bottom disc-shaped surface 22' are in parallel spaced relation with each other and the free space created by the gap therebetween has filled therein the gaseous medium 40.

The vertically upright cylindrical wall enclosure 20*b* comprises a outer cylindrical wall 27*a* coupled to the outer perimeter of the bottom disc-shaped surface 22' and an inner cylindrical wall 27*b* coupled to the outer perimeter of the top disc-shaped surface 21'. The top free edges of the outer cylindrical wall 27*a* and the inner cylindrical wall 27*b* are closed and sealed via ring wall structure 27*c*. The ring wall structure 27*c* has coupled thereto a continuous beam deflecting ring member 35'.

Furthermore, the interior surface of the lower corner of the laser encapsulation chamber 20' defined by the juncture of the outer cylindrical wall 27*a* and outer perimeter of the bottom disc-shaped surface 22' there is coupled a continuous beam upward deflecting ring member 35*a'*, such as a reflective mirror which reflects laser beams 1*a'* and 1*b'* upward to the continuous beam deflecting ring member 35' located at the top ring wall structure 27*c*.

When using the laser encapsulation chamber 20' shown in FIG. 4, preferably, the laser beam is split in a similar manner as described in relation to FIGS. 2 and 3. The rotating laser beam splitter deflector 30" of FIG. 4 differs from FIGS. 2 and 3 in that the angled deflector surfaces are defined by a generally V-shape in lieu of upper and lower angled deflector surfaces 31*a'* and 31*b'*.

In operation, the laser beam 1, 1*a* and 1*b* or 1*a'* and 1*b'* agitate the molecules of the gaseous medium 40, and the heat can produce heat energy having a temperature of at least about two thousand (2,000° F.) degrees Fahrenheit. In the preferred embodiment, the temperature produced by the high heat producing device 10 does not exceed three thousand (3,000° F.) degree Fahrenheit. Nevertheless, in certain environments, it may be desirable to produce temperatures significantly greater than three thousand (3,000° F.) degrees Fahrenheit or significantly lower than two thousand (2,000° F.) degrees Fahrenheit.

A relatively low voltage is applied to laser source 50 which in turn creates laser beam 1. As the rotating laser beam deflector 30 spins via the mechanical rotor energy of rotor means 70, laser beam 1 is or, alternately, laser beams 1*a* and 1*b* are likewise spun and deflected and propagated radially outward from the center axis through the gaseous medium 40 and to the continuous beam deflecting ring member 35. Thereby, the laser beam 1 or, alternately, laser beams 1*a* and 1*b* follow the spin path around the continuous beam deflecting ring member 35.

As can be appreciated, if visually observed, a continuous illuminating heat energy field is created since the at least one laser beam 1 or, alternately, laser beams 1*a* and 1*b* follow around the continuous beam deflecting ring member 35 as the rotating laser beam deflector 30 or, alternately, the rotating laser beam splitting deflector 30' is rotated.

For exemplary purposes, the laser beams 1, 1*a* and 1*b* have a base temperature and are propagated in the gaseous medium 40 occupying the free space in the laser encapsulation chamber 20. The heat energy of the laser beams 1, 1*a* and 1, 1*b* heat the gaseous medium 40. For exemplary purposes, the gaseous medium 40 is mercury.

Nevertheless, the gaseous medium 40 may comprise other gases which can propagate therethrough the laser beam 1, 1*a* and 1*b* in the laser encapsulation chamber 20. As the heat energy of the laser beams 1, 1*a* and 1*b* are transferred to the gaseous medium 40, the molecules of the gaseous medium 40 become agitated, and the temperature of the gaseous medium 40 increases to at least about three thousand (3,000° F.) degrees Fahrenheit.

Systems which convert heat energy to into mechanical or electrical energy are known. For example, boilers and turbines are well known and utilize thermodynamic properties which have been well established to convert heat energy into mechanical or electrical energy.

The operation of FIG. 4 differs from the operation of FIGS. 1–3 only in that laser beams 1*a'* and 1*b'* are deflected upward by continuous beam upward deflecting ring member 35*a'* to the continuous beam deflecting ring member 35' located at the upper rim of the vertically upright cylindrical wall enclosure 20*b*.

Referring now to FIG. 5, an exemplary closed looped turbine engine system 100 is shown. The laser encapsulation chamber 20 is disposed in the expansion chamber 90. Henceforth, the high heat producing device 10 is in direct heat transfer relationship with the working fluid medium 105 of the expansion chamber 90.

The expansion chamber 90 receives therein a working fluid medium 105 such as mercury, water, distilled water, freon or other means of working fluid mediums which when heated has expansion properties. The expansion chamber is in communication with turbine engine 110 or other means capable of converting heat energy to mechanical or electrical energy.

In operation, power is supplied to the laser beam source 50 to create laser beam 1, or 1*a* and 1*b* and to power rotor means 70. The laser beams 1, or 1*a* and 1*b* heats the gaseous medium 40 sealed in the laser encapsulation chamber 20. The heat energy of the laser encapsulation chamber 20 is transferred directly to the working fluid medium 105 filled in the expansion chamber 90. The heat energy transfer increases the temperature of the working fluid medium 105 injected into the expansion chamber 90, wherein the expansion properties of the working fluid medium 105 when such working fluid medium 105 is heated causes the turbine engine 110 or other means capable of converting heat energy to mechanical or electrical energy to convert the heat energy of the expansion chamber to mechanical or electrical energy at output 108. As the expanded working fluid medium 105 is compressed in compression chamber 115, the compressed working fluid medium 105 is injected into the expansion chamber 90.

The heat energy of the high heat producing devices 10 of the various embodiments merely utilizes a relatively low voltage power a laser beam source 50 to create a laser beam 1 wherein the temperature of the laser beam 1 agitates the molecules to create friction therebetween which thus increases the temperature of the high heat producing device 10 to heat a working fluid medium and thus further derive mechanical or electrical energy.

Of course, the foregoing is merely exemplary of the many different ways the laser encapsulation chamber 20 can be contoured and the high heat producing device of the present invention can be used in connection with heat convertible to mechanical or electrical energy.

It is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A high heat producing system, comprising:

an enclosure having a center axis and enclosing free space wherein said enclosure is defined by a top surface member and a bottom surface member in parallel spaced relation, each member having an outer perimeter edge, and an outer perimeter surface coupled to the outer perimeter edge of said top and bottom surface members and wherein said enclosure radiates heat energy therefrom;

a gaseous medium filled in said free space having molecules;

a continuous beam deflecting ring member coupled to an interior surface of said outer perimeter surface;

a rotating laser beam deflector coupled in a center axis of said bottom surface member; and a laser beam source for radiating a laser beam upward along the center axis to said rotating laser beam deflector wherein said rotating laser beam deflector deflects the laser beam radially from the center axis through the gaseous medium to the continuous beam deflecting ring member to agitate said molecules.

2. The high heat producing system of claim 1, wherein:

an interior surface of said bottom surface member has coupled thereto a heat reflector member to reflect heat energy from said bottom surface member to said top surface member.

3. The high heat producing system of claim 1, wherein said enclosure further comprises a laser beam deflecting chamber formed in the center axis wherein said laser beam deflecting chamber housed therein said rotating laser beam deflector; said rotating laser beam deflector comprises:

a hollow shaft member coupled concentric with said laser beam deflecting chamber and propagates therethrough said laser beam;

an angled deflector surface fixedly coupled to said hollow shaft member wherein said angled deflector surface reflects angularly downward at a predetermined angle from the center axis to deflect radially outward through the laser beam deflecting chamber the laser beam.

4. The high heat producing system of claim 3, further comprising a means for rotating said hollow shaft member, said rotating means comprises:

a permanent magnet rotor;

a non-magnetic electric insulator member coupled to said permanent magnet rotor; and a donut stator coupled to said non-magnetic electric insulator member.

5. The high heat producing system of claim 3, wherein:

said enclosure is sealed and is disc-shaped and said top and bottom surface members are disc-shaped; and wherein:

said laser beam deflecting chamber is made of transparent material to permit the laser beam to propagate therethrough.

6. The high heat producing system of claim 1, wherein:

said rotating laser beam deflector splits said laser beam propagated along the center axis into two laser beams space substantially 180 degrees from the other, wherein said rotating laser beam deflector comprises a top angled deflector surface and a bottom angled deflector surface which serve to deflect the laser beam radiated along the center axis into an upper and lower laser beam which radially propagate to the continuous beam deflecting ring.

7. The high heat producing system of claim 1, wherein:

said enclosure is housed in an expansion chamber of a turbine engine system and heats a working fluid medium filled in said expansion chamber having expansion properties when heated.

8. The high heat producing system of claim 1, wherein:

said laser beam source is adapted to heat said enclosure to as much as about two thousand (2,000° F.) degrees Fahrenheit.

9. The high heat producing system of claim 1, wherein:

said bottom surface member has coupled thereto an inlet/outlet port and pressure valve member.

10. A high heat producing system, comprising:

an enclosure having a generally bottom disc-shaped enclosure portion having an outer perimeter, a center axis and a vertically upright cylindrical wall enclosure portion coupled to said outer perimeter of said generally bottom disc-shaped enclosure portion wherein said enclosure radiates heat energy therefrom, said cylindrical wall enclosure portion having a top rim;

a gaseous medium filled in said enclosure having molecules;

a continuous beam upward deflecting ring member coupled to an interior surface of said outer perimeter of said generally bottom disc-shaped enclosure portion;

a rotating laser beam deflector coupled in the center axis of said generally bottom disc-shaped enclosure portion; and a laser beam source for radiating a laser beam upward along the center axis to said rotating laser beam deflector wherein said rotating laser beam deflector deflects the laser beam radially from the center axis through the gaseous medium to the continuous beam upward deflecting ring member to agitate said molecules and wherein the continuous beam upward deflecting ring member deflects said laser beam therefrom upward to said continuous beam upward deflecting ring member at said top rim.

11. The high heat producing system of claim 10, wherein said enclosure further comprises a laser beam deflecting chamber formed in the center axis wherein said laser beam deflecting chamber housed therein said rotating laser beam deflector; said rotating laser beam deflector comprises:

a hollow shaft member coupled concentric with said laser beam deflecting chamber and propagates therethrough said laser beam;

an angled deflector surface fixedly coupled to said hollow shaft member wherein said angled deflector surface reflects angularly downward at a predetermined angle from the center axis to deflect radially outward through the laser beam deflecting chamber the laser beam.

12. The high heat producing system of claim 11, further comprising a means for rotating said hollow shaft member, said rotating means comprises:

a permanent magnet rotor;

a non-magnetic electric insulator member coupled to said permanent magnet rotor; and a donut stator coupled to said non-magnetic electric insulator member.

13. The high heat producing system of claim 11, wherein:

said enclosure is sealed and is disc-shaped and said top and bottom surface members are disc-shaped; and wherein:

said laser beam deflecting chamber is made of transparent material to permit the laser beam to propagate therethrough.

14. The high heat producing system of claim 10, wherein:

said rotating laser beam deflector splits said laser beam propagated along the center axis into two laser beams space substantially 180 degrees from the other, wherein said rotating laser beam deflector comprises a top angled deflector surface and a bottom angled deflector surface which serve to deflect the laser beam radiated along the center axis into an upper and lower laser beam which radially propagate to the continuous beam deflecting ring.

15. The high heat producing system of claim 10, wherein:

said enclosure housed in an expansion chamber of a turbine engine system and heats a working fluid medium filled in said expansion chamber having expansion properties when heated.

16. The high heat producing system of claim 10, wherein:

said laser beam source is adapted to heat said enclosure to as much as about two thousand (2,000° F.) degrees Fahrenheit.

17. A method of producing high heat, comprising the following steps:

providing a high heat producing system wherein said high heat producing system, includes—an enclosure having a center axis and has free space wherein said enclosure is defined by a top surface member and a bottom surface member in parallel spaced relation and an outer perimeter surface coupled to the outer perimeter edge of said top and bottom surface members and wherein said enclosure radiates heat energy therefrom, a gaseous medium filled in said free space having molecules; a continuous beam deflecting ring member coupled to an interior surface of said outer perimeter surface, a rotating laser beam deflector coupled in a center axis of said bottom surface member, and a laser beam source for radiating a laser beam upward along the center axis;

propagating said laser beam along said center axis to said rotating laser beam deflector;

rotating said rotating laser beam deflector and simultaneously deflecting said laser beam radially from said center axis through said gaseous medium; and agitating molecules of the gaseous medium as said laser beam is propagated through said gaseous medium and creating friction between the molecules to increase the heat energy of said enclosure.

18. The method of claim 17, wherein there is included the step of:

using as the laser beam to heat said gaseous medium to a temperature level of at least about two thousand (2,000° F.) degrees Fahrenheit.

19. The method of claim 17, wherein there is included the step(s) of:

using said enclosure in an expansion chamber of a turbine engine system and to heat a working fluid medium having expansion properties when heated filled in said expansion chamber.

20. The method of claim 17, wherein the step of rotating said rotating laser beam deflector and simultaneously deflecting said laser beam radially from said center axis further includes splitting said laser beam into two laser beams spaced substantially 180 degrees from each other.

* * * * *